United States Patent [19]

York, deceased

[11] Patent Number: 5,026,277

[45] Date of Patent: Jun. 25, 1991

[54] REGENERATIVE THERMAL INCINERATOR APPARATUS

[75] Inventor: James A. York, deceased, late of Glendale, Calif., by Dorothy M. York, legal representative

[73] Assignee: Smith Engineering Company, Duarte, Calif.

[21] Appl. No.: 443,753

[22] Filed: Nov. 30, 1989

[51] Int. Cl.[5] ..... F27D 17/00

[52] U.S. Cl. ..... 432/181; 432/180; 432/2; 432/14; 165/7; 110/212

[58] Field of Search ..... 432/2, 14, 163, 164, 432/165, 166, 170, 171, 172, 176, 179, 180, 181; 110/315, 212, 203, 211, 190; 422/171, 173, 175, 176; 165/4, 5, 7

[56] References Cited

U.S. PATENT DOCUMENTS

| | | | |
|---|---|---|---|
| 2,689,722 | 9/1954 | Knight | 432/163 |
| 3,870,474 | 3/1975 | Houston | 432/181 X |
| 3,895,918 | 7/1975 | Mueller | 110/212 X |
| 4,252,070 | 2/1981 | Benedick | 110/211 |
| 4,424,857 | 1/1984 | Linde | 165/7 X |
| 4,650,414 | 3/1987 | Grenfell | 110/212 X |

FOREIGN PATENT DOCUMENTS

| | | | |
|---|---|---|---|
| 760273 | 10/1956 | United Kingdom | 432/181 |
| 1455601 | 11/1976 | United Kingdom | 432/163 |

*Primary Examiner*—Henry A. Bennett
*Assistant Examiner*—Christopher B. Kilner
*Attorney, Agent, or Firm*—Christie, Parker & Hale

[57] ABSTRACT

The present invention is a regenerative gas incineration apparatus having three heat regenerators containing refractory heat exchange material. Gas is cycled through the regenerators first in one direction, then in another. The regenerators are each connected to combustion chamber having an air-fuel system and at least one burner. A system of valved ductwork is utilized to direct gas to be processed into and upwardly through a heating first regenerator into the combustion chamber, downwardly through a cooling second regenerator and exhausting the processed gas to the atmosphere. The temporarily idle third regenerator is purged of partially treated gas remaining from a previous cycle and this gas is directed to the combustion chamber. The flow of the gas through the system is periodically changed enable the heat recovered by cooling regenerator in the previous cycle to be used to heat incoming gas in the next. Each of cycle results in the former heating regenerator to become the idle regenerator, the former cooling regenerator to become the heating regenerator and the former idle regenerator to become the cooling regenerator.

11 Claims, 2 Drawing Sheets

Fig. 2
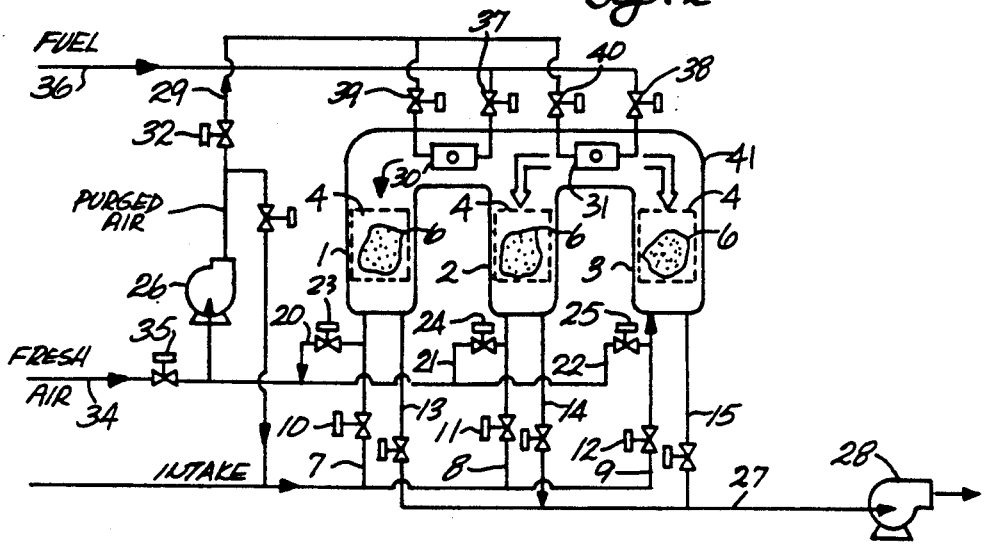
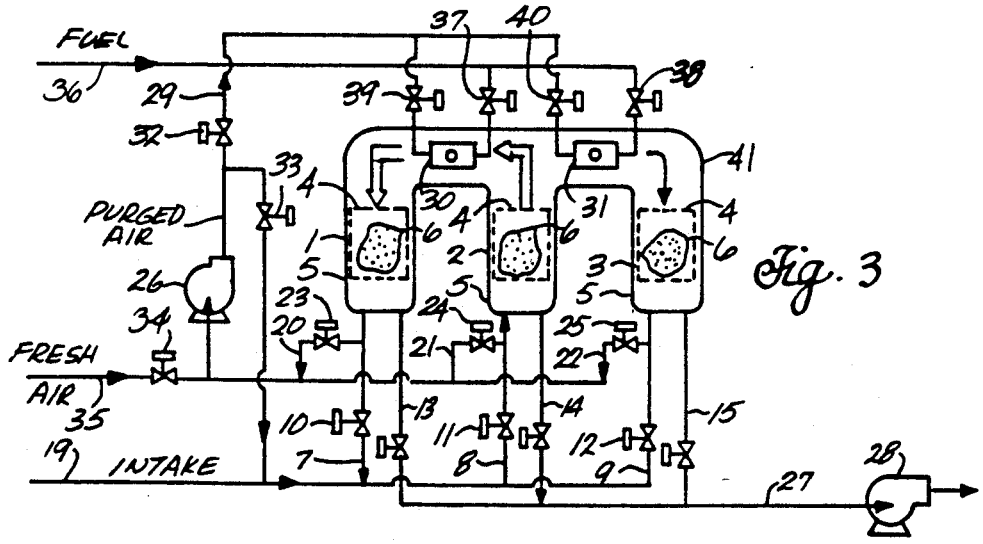
Fig. 3
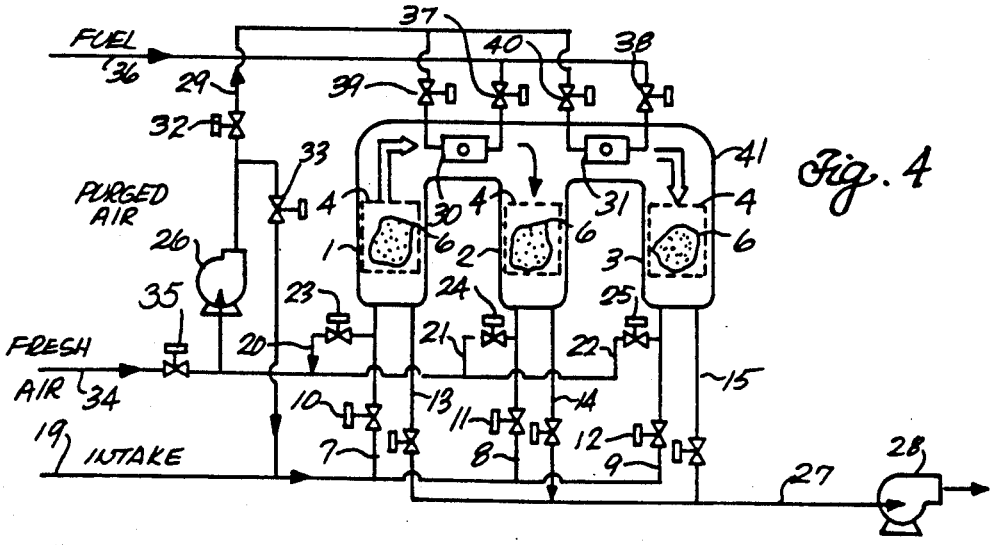
Fig. 4

REGENERATIVE THERMAL INCINERATOR APPARATUS

BACKGROUND OF THE INVENTION

1. Field of the Invention

The present invention relates generally to reversing flow regenerative incinerator systems for waste gases containing volatile hydrocarbon compounds, and more particularly, to purging and ,treating entrapped gas during flow reversal periods, in order to ensure attaining and maintaining high incinerator system destruction efficiency.

2. Description of the Prior Art

Regenerative incinerator systems use gas flow reversal to recapture heat which would otherwise be lost to the atmosphere. Regenerative incinerator systems consist minimally of a gas heating regenerator which receives the gas, a burner to oxidize the gas and a regenerator which cools the gas reclaiming some of the heat of the combustion process. After a period of time the flow of gas through the system is reversed. The exhaust regenerator now becomes the heating regenerator and the former gas heating regenerator now becomes the cooling regenerator through which the gas passes prior to being released to the atmosphere.

A problem exists with this system during flow reversal. The intake regenerator contains unburned gases which would be released if not purged prior to flow reversal. Current regenerative incinerator systems use positive pressure within the intake regenerator to purge these gases prior to flow reversal. Incinerated air is introduced into the regenerator which forces the residual gas up through a media bed and into the combustion chamber. This leaves incinerated air in the regenerator to be exhausted when the gas flow is reversed. The introduction of this incinerated air causes the system (exhaust fan) to handle this recycled air a second time. This requires a larger induced draft fan and requires burning of the recycled incinerated air, thus increasing fuel usage. This mandates a design requirement for larger processing systems with accordingly increased costs of construction and operation.

The present invention uses negative pressure, rather than positive pressure to purge the intake regenerator. The residual gas within the intake regenerator is removed by suction from the combustion air fan prior to flow reversal. The present invention removes by negative pressure the air from the intake regenerator and voids in the ceramic media, utilizing the combustion fan and then sends it to the combustion burners. Any excess over and above what the combustion burners require will be returned to the inlet. This reduces the need for fuel and/or outside combustion air, depending on the composition of the purged air. The system need not be oversized, as with current systems, due to the lower volume of purging air needed and its efficient use. The result is a significant savings in construction and operation.

The present system may also employee a separate fan to purge the third idle vessel and return the purge air back to the inlet of the regenerative system, rather than using the combustion blower for purging. A combination of blowers may also be used in moving the purged air to the combustion burners. One blower can be used for high pressure combustion air for preheat of the ceramic media and one blower can be used for low pressure for continuous operation after pre-heat. The existing system uses positive pressure within the intake regenerator to force the heavier-than air solvents in the contaminated gas up into the combustion chamber. This works against gravity. The current invention cooperates with the settling effect of gravity on the heaver entrapped solvents in the process system, by placing its purging inlet at the bottom of the regenerator. The efficiency of removal is increased and; therefore, heavy solvents ,in the gas remaining in the inlet regenerator is reduced. This will reduce the amount of purge required and will insure more complete removal of the solvents. This provides for a higher destruction efficiency of the regenerative incineration system.

The invention, as does the prior art, utilizes dampers to control the flow of gas and contaminated air through the system. All dampers have some leakage. Such leakage allows small amounts of untreated gas and air to be exhausted into the atmosphere. One embodiment of the invention utilizes valves at critical locations consisting of single dampers with double blades with a fresh air source between them. Leakage of such single dampers with double dampers results in the movement of atmosphere air rather than gas or contaminated air into the atmosphere.

The prior art typically removed 95–98% of the hydrocarbons from the treated gas as determined from measured inlet and outlet hydrocarbon concentrations. The result of all of the above improvements provided by the present invention is the removal of 98%–99% of hydrocarbons from the processed gas and reduced combustion fuel usage.

SUMMARY OF THE INVENTION

The present invention comprises three vertical heat exchange regenerators located adjacent to each other. Each regenerator contains refractory heat exchange material which preheats incoming gas and cools oxidized gas prior to exhausting it to the atmosphere. Gas is cycled through the regenerators first in one direction, then in another. The regenerators are each connected to a combustion chamber having an air-fuel system and at least one burner. A system of valved ductwork is utilized to direct the gas to be processed into and upwardly through a heating first regenerator into the combustion chamber, downwardly through a cooling second regenerator and finally exhausting the processed gas to the atmosphere. The temporarily idle third regenerator is simultaneously purged of partially treated gas remaining from a previous cycle. The purged gas is directed to the combustion fan and thence to the combustion chamber's burners. The direction of flow of the gas through the system is periodically changed to enable the heat recovered by cooling the processed gas in one cycle to be used to heat incoming gas in the next. Each change of cycle results in the former heating regenerator to become the idle regenerator, the former cooling regenerator to become the heating regenerator and the former idle regenerator to become the cooling regenerator.

BRIEF DESCRIPTION OF THE DRAWINGS

FIGS. 2 through 4 are schematic flow diagrams showing the various cycles of operation of the preferred embodiment of the invention.

DETAILED DESCRIPTION OF THE PREFERRED EMBODIMENT

Figure 1:
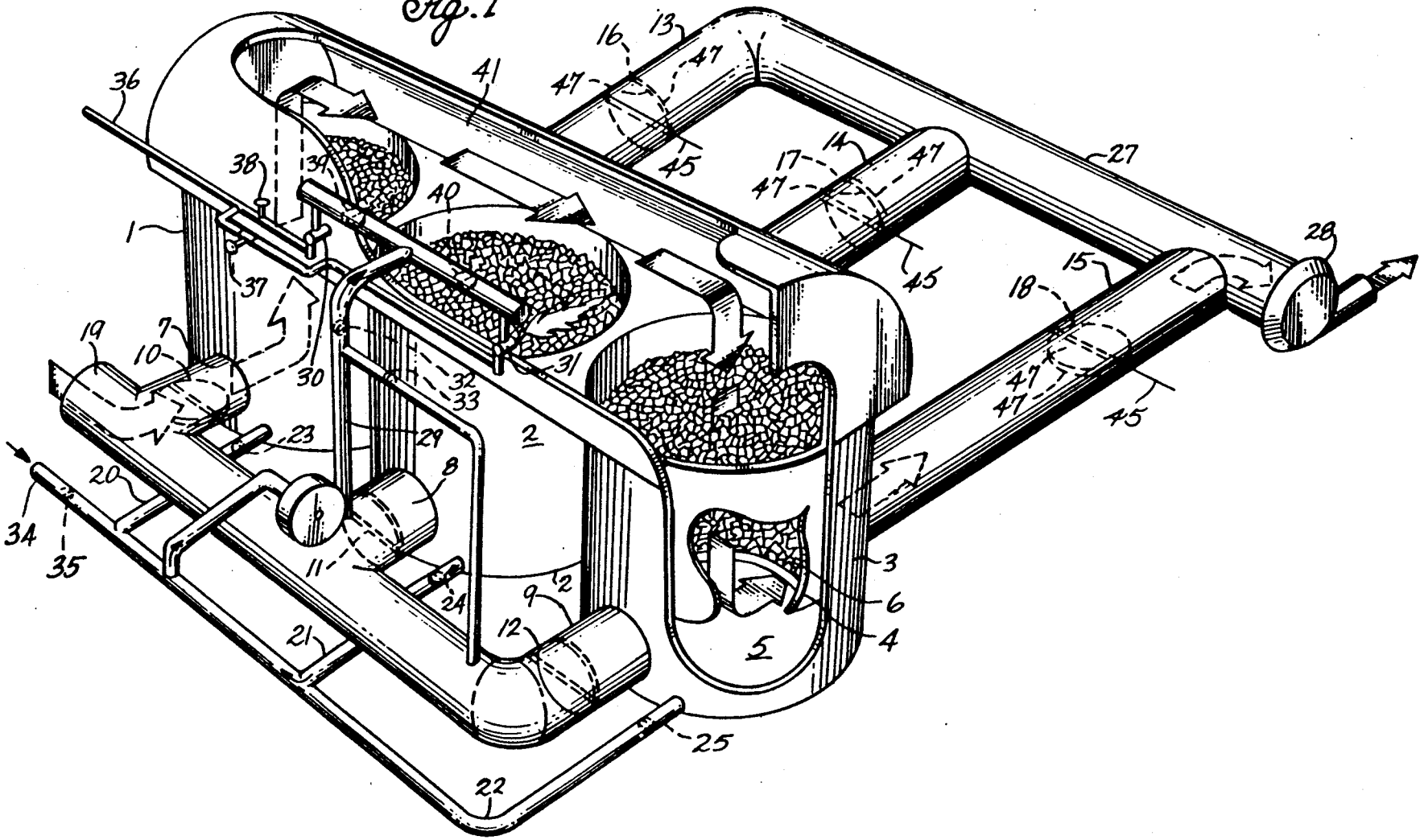
FIG. 1 is an isometric view of a preferred embodiment of the invention.

Referring now in detail to FIGS. 2 through 4, there is shown a preferred embodiment of the regenerative thermal incinerator in accordance with this invention which comprises three regenerators 1, 2 and 3 each consisting of a gas permeable support structure 4 above a closed space 5. The space above support structure 4 is filled with a suitable refractory heat exchange material 6 such as chemical porcelain quartz gravel, metal or ceramic pieces.

Connected to the base of the regenerators 1, 2 and 3 are inlet conduits 7, 8 and 9, respectively, each containing a suitable damper valve 10, 11, and 12 which may be positioned open or closed for selectively communicating the regenerators with intake conduit 19. Gas, contaminated air or other gaseous effluent ("effluent") is received into intake conduit 19 which communicates with inlet conduits 7, 8 and 9.

Also connected to the base of the regenerators 1, 2, and 3 are outlet conduits 13, 14 and 15, respectively. each containing a suitable damper valve 16, 17, and 18 which may be positioned open or closed for selectively communicating the regenerators with exhaust conduit 27. An exhaust fan 28 may be connected to the exhaust conduit 27 to assist in venting the processed effluent to the atmosphere.

Additionally connected to the base of the regenerators 1, 2 and 3 are purging conduits 20, 21 and 22, respectively, each containing a suitable damper valve 23, 24 and 25 which may be opened or closed for selectively communicating the purging air to purging fan 26 and filter 26*a*. A purge air conduit 29 from the purging fan 26 is connected to burners 30 and 31 and to intake conduit 19 through damper valves 32 and 33 respectively. Conduit 29 additionally contains suitable damper valves 39 and 40 for individual control of the purged air to burners 30 and 31, respectively. Conduit 34 containing a suitable damper valve 35 which provides a fresh air source for the burners through purging fan 26 for preheat of the ceramic media. Valves 32 and 33 control the supply of purged air to burners 30 and 31 returning any excess to the intake conduit 19. Conduit 36 delivers fuel to the burners 30 and 31 through suitable fluid valves 37 and 38 respectively.

Regenerators 1, 2 and 3 open into and are in communication with a common combustion chamber 41. Burners 30 and 31 open into the combustion chamber 41 to incinerate any hydrocarbons or other reducible contaminants from the effluent and to convert essentially all of them to harmless carbon dioxide and water vapor.

The flow of effluent through the apparatus is cycled through different regenerators every 60-to-90 seconds so that the heat which is extracted by the refractory heat exchange materials from the hot processed effluent can be used to preheat the incoming effluent. Thus, thereby, substantially reduces the amount of fuel required to heat the effluent to the desired oxidization temperature.

A potential problem arises when a cycle change causes the flow of effluent through a regenerator to reverse direction. Specifically, the effluent which has just entered the heating (intake) regenerator would be, immediately after such flow reversal, expelled into the exhaust conduit 27 and then into the atmosphere without having passed entirely through the regenerative apparatus. The current invention prevents such expulsion of any untreated or partly treated effluent from the apparatus during such reversals by purging each regenerator after its use as the intake regenerator. During this purging the other two regenerators are used as the intake and exhaust regenerators.

As shown in the FIG. 2, a cycle begins when intake valves 7, 8 and 9, and exhaust valves 10, 11 and 12 are positioned so that the effluent from the intake conduit 19 is passed into the bottom of regenerator 3, up through the refractory heat exchange material 6 and into the combustion chamber 41. Valves 32, 34, 37, 38, 39 and 40 are positioned to supply fuel and air to burners 30 and 31 to raise the average temperature of the effluent in the combustion chamber up to 1500° F. or higher. if necessary, to oxidize hydrocarbons and other reducible contaminants in the effluent.

From the combustion chamber 41 the purified heated effluent is passed into regenerator 2. As the heated effluent passes through the refractory material 6, heat is transmitted from the effluent to the refractory material for use in preheating the incoming air during the next cycle. After passing out of regenerator 2, through conduit 14 and valve 17 the now cooled treated effluent passes through exhaust conduit 27, exhaustion fan 28 and out into the atmosphere.

Purging valves 24 and 25 are closed and valve 23 is open so that an additional negative pressure is created in the idle regenerator 1. A small portion of the processed effluent in the combustion chamber 41 is caused to flow down regenerator 1 through the medica, into open space 5, into conduit 20, to filter 26*a* and fan 26 during the entire cycling of the main flow through the other two regenerators. It is estimated that less than 5%-100% of the main effluent flow will fully purge the regenerators of any untreated effluent. Valves 32, 33, 39 and 40 are positioned to permit the processed purging effluent (purging air) to flow out of regenerator 1 through conduit 20, filter 26*a*, the purging fan 26 and into the burners 30 and 31. Fuel valves 37 and 38, and fresh air valve 35 are adjusted based on the oxygen and fuel content of the purging air for minimum usage of fuel and minimum intake of fresh air for operation of the burners. Purging air in excess of that needed for the burners may be vented to intake conduit 19 by valve 33.

Upon completion of the first cycle, as determined by a timer or temperature sensors, the intake and exhaust valves may be automatically repositioned so that the intake effluent enters regenerator 2 to make use of the heat retained by the refractory heat exchange material 6 therein to preheat the incoming effluent. The effluent passes from regenerator 2 through the combustion chamber and out through the now purged regenerator 1 as shown in FIG. 3. The purging valves may be also automatically repositioned to permit regenerator 3 to be purged in preparation for the next cycle.

When the second cycle is completed, the intake, exhaust and purging valves are again repositioned for a third cycle so that the incoming effluent enters through regenerator 1 and exits through regenerator 3, while regenerator 2 is purged as shown in FIG. 4. After completion of the third cycle, cycle one is repeated and so on.

FIG. 2, 3 and 4 indicate the use of two blowers, one of which uses atmospheric air for air to the burners. The second blower is used to purge vessels 1, 2, and 3, and return the untreated gas back to the inlet of the system. As noted and as previously discussed, the sequence of operation is the same for purging as is shown in FIG. 2, 3, and 4.

All dampers have some leakage. In another embodiment of the invention, single dampers with dual blades 47 are used for the exhaust valves 16, 17 and 18. A conduit 45 to the atmosphere is placed between the dual blades in each valve as shown in FIG. 1. Dampers of this type are illustrated in U.S. Pat. No. 4,191,212. When the valve is closed, any leakage past the valve will contain only atmospheric air from the conduit to the atmosphere. When the valve is open, the conduit to the atmosphere is closed. The use of such dual blades in a single damper further reduces leakage of unprocessed effluent past the dampers to the atmosphere.

What is claimed is:

1. A regenerative thermal incineration apparatus comprising:

three regenerators each containing refractory heat exchange materials;

means for directing an effluent to be processed into the regenerators;

means for removing the effluent after processing from the regenerators and exhausting the processed effluent to atmosphere;

a combustion chamber common to and communicating with all of the regenerators having an air-fuel system and at least one burner;

means or selectively directing the effluent to be processed through a heating first regenerator, then to the combustion chamber and thereafter to a cooling second regenerator;

means for purging an idle third regenerator of any residual effluent therein and reciting the purged effluent out of the third regenerator in a direction away from combustion chamber; and means for periodically altering the direction of flow of the effluent through the apparatus such that the former heating regenerator becomes the idle regenerator, the former cooling regenerator becomes the heating regenerator and the former idle regenerator becomes cooling regenerator.

2. An apparatus according to claim 1 wherein the purging means includes a fan for pulling effluent for the idle third regenerator and thereafter directing the residual effluent to the burner.

3. An apparatus according to claim 2 wherein the purging means is in communication with the end of the regenerators opposite the combustion chamber.

4. An apparatus according to claim 1 wherein the combustion chamber contains at least two burners placed at predetermined locations to more efficiently oxidize the effluent passing therethrough.

5. An apparatus according to claim 1 wherein means for periodically altering the direction of flow of the effluent includes dual blade damper valves having a conduit to the atmosphere communicating with the space between the blades for reducing leakage of unprocessed effluent to the atmosphere.

6. A regenerative thermal incineration apparatus comprising:

first, second and third vertical heat exchange regenerators located adjacent to each other, each regenerator containing a predetermined quantity of refractory heat exchange material supported by a gas permeable means;

means for supplying an effluent to be processed to a selected one of the regenerators;

means for removing any residual effluent from a selected regenerator;

a combustion chamber common to and communicating with the three regenerators having an air-fuel system and at least one burner;

means for directing the effluent to be processed upwardly through a heating first regenerator into the combustion chamber and for the combustion chamber downwardly through a cooling second regenerator into a space beneath the second regenerator;

means connected to the spaces beneath the regenerators for extracting any remaining effluent from an idle third regenerator in the direction away from the combustion chamber; and means for periodically altering the direction of flow of the effluent such that the former heating regenerator becomes the idle regenerator, the former cooling regenerator becomes the heating regenerator and the former idle regenerator becomes cooling regenerator.

7. An apparatus according to claim 6 wherein the means connected to the regenerators for extracting the residual effluent remaining in an idle third regenerator for the bottom thereof communicates said residual effluent to the burner for the combustion chamber.

8. An apparatus according to claim 7 wherein the means connected to the regenerators for extracting effluent remaining in a idle third regenerator communicate said effluent to the means for supplying the effluent to be processed to an intake of a selected one of the regenerators.

9. An apparatus according to claim 6 wherein means for periodically altering the direction of flow of the effluent includes dual blade damper valves having a conduit to the atmosphere communicating with the spaced between the blades for reducing leakage of unprocessed effluent to the atmosphere.

10. A process for continuous regenerative thermal incineration of an effluent comprising an apparatus having three regenerators each containing refractor heat exchange materials, means for directing the effluent to be processed into the regenerators, means for removing ne effluent after processing from the regenerators and exhausting the processed effluent into the atmosphere, a combustion chamber common to an commmunicating with all of the regenerators having an air-fuel system and at least one burner, means for selectively directing an effluent to be processed through a heating first regenerator, to the combustion chamber and and thereafter to a cooling second regenerator, means for purging with negative pressure an idle third regenerator of any effluent therein and directing the purged effluent into the burner for the combustion chamber and means for periodically altering the direction of flow of the effluent such that the former heating regenerator becomes the idle regenerator, the former cooling regenerator becomes the heating regenerator and the former idle regenerator becomes cooling regenerator.

11. A process according to claim 10 wherein the means or periodically altering he direction of flow of the effluent and the purging of the three regenerators, designated as the 1st, 2nd and 3rd regenerator, does so according to the following three cycles:

| Cycle Number | Intake Regenerator | Exhaust Regenerator | Purged Regenerator |
|---|---|---|---|
| | REGENERATOR | | |
| 1 | 3rd | 2nd | 1st |
| 2 | 2nd | 1st | 3rd |
| 3 | 1st | 3rd | 2nd |

* * * * *